US009751594B2

(12) United States Patent
Rickborn

(10) Patent No.: US 9,751,594 B2
(45) Date of Patent: Sep. 5, 2017

(54) HIGH STABILITY LOW DRAG BOAT HULL

(71) Applicant: Chris Rickborn, Hollywood, FL (US)

(72) Inventor: Chris Rickborn, Hollywood, FL (US)

( * ) Notice: Subject to any disclaimer, the term of this patent is extended or adjusted under 35 U.S.C. 154(b) by 0 days.

(21) Appl. No.: 15/071,007

(22) Filed: Mar. 15, 2016

(65) Prior Publication Data

US 2016/0194055 A1 Jul. 7, 2016

Related U.S. Application Data

(63) Continuation-in-part of application No. 14/280,143, filed on May 16, 2014, now Pat. No. 9,284,019.

(60) Provisional application No. 61/824,339, filed on May 16, 2013.

(51) Int. Cl.

| | |
|---|---|
| ***B63B 3/38*** | (2006.01) |
| ***B63B 1/04*** | (2006.01) |
| ***B63B 1/20*** | (2006.01) |
| ***B63B 5/24*** | (2006.01) |

(52) U.S. Cl.

CPC ..... *B63B 3/38* (2013.01); *B63B 1/042* (2013.01); *B63B 1/20* (2013.01); *B63B 5/24* (2013.01); *B63B 2001/201* (2013.01)

(58) Field of Classification Search

CPC .... B63B 1/00; B63B 5/24; B63B 1/20; B63B 3/14; B63B 1/042; B63B 3/38; B63B 2001/201

USPC ..... 114/61.26, 61.32, 61.33

See application file for complete search history.

(56) References Cited

U.S. PATENT DOCUMENTS

| | | | | |
|---|---|---|---|---|
| 3,045,629 | A * | 7/1962 | Farrington | B63B 1/18 114/61.32 |
| 3,117,544 | A * | 1/1964 | Schoell | B63B 1/20 114/61.32 |
| 4,027,613 | A | 6/1977 | Wollard | |
| 4,074,646 | A | 2/1978 | Dorfman et al. | |
| 4,128,072 | A | 12/1978 | Wood, Jr. | |
| 4,165,703 | A | 8/1979 | Burg | |
| 4,193,370 | A | 3/1980 | Schoell | |
| 4,584,959 | A | 4/1986 | Allison | |
| 4,672,905 | A | 6/1987 | Pipkorn | |
| 4,924,797 | A | 5/1990 | Solia | |
| 4,958,585 | A | 9/1990 | Caldwell, Jr. | |
| 5,016,552 | A | 5/1991 | Ludlow | |
| 5,125,352 | A | 6/1992 | Shields | |

(Continued)

FOREIGN PATENT DOCUMENTS

EP 0033563 B1 6/1985

*Primary Examiner* — Lars A Olson

(74) *Attorney, Agent, or Firm* — Allen F. Bennett; Bennett Intellectual Property

(57) ABSTRACT

A modified V-hull boat has a keel starting at about 20% from the bow ending 75 to 80% aft of the bow and has an inverted airfoil shape. A flat pad blends in aft of the keel assisting planning and attitude at speed. A bracket having a bottom shape and size to float a designated amount of weight and a downward angle facing down at the aft on the bottom to act as a positive planning fixed trim tape that ride's above the water at speed or on plane, and adds stability and positive buoyancy for weight of engines at rest or low speed.

Chine's are the outside corner of the boat joining the bottom to the side's. The chine's taper slightly inboard aft to relieve friction and drag. Although they do not come together the chine is no way a straight line the outer edges are slightly more ellipsoidal hence the name.

13 Claims, 6 Drawing Sheets

(56) References Cited

U.S. PATENT DOCUMENTS

| | | | | |
|---|---|---|---|---|
| 5,456,202 | A | 10/1995 | Schoell | |
| RE36,879 | E | 9/2000 | Schoell | |
| 6,216,622 | B1 | 4/2001 | Lindstrom et al. | |
| 6,675,736 | B1 * | 1/2004 | Schreiber | B63B 1/042 114/290 |
| 6,964,240 | B1 * | 11/2005 | Duncan | B63B 1/16 114/61.26 |
| 7,543,544 | B2 | 6/2009 | Yap | |
| 7,984,683 | B1 | 7/2011 | Hupy | |
| 8,291,850 | B1 | 10/2012 | Peters | |
| 9,284,019 | B2 * | 3/2016 | Rickborn | B63B 1/20 |
| 2011/0297069 | A1 | 12/2011 | Quimby | |
| 2013/0152843 | A1 | 6/2013 | Connett, Jr. et al. | |

* cited by examiner

HIGH STABILITY LOW DRAG BOAT HULL

CROSS-REFERENCE TO RELATED APPLICATIONS

This application is a continuation-in-part of U.S. Pat. No. 9,284,019 filed on May 16, 2014 and issued on Mar. 15, 2016 and claims priority to U.S. Provisional Application Ser. No. 61/824,339 filed on May 16, 2013, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

Field of Endeavor

The present invention relates to apparatuses, systems and methods for improved boat of both mono-hull and multi-hull designs. More particularly, the invention relates to boat hulls modified to provide better fuel economy, maneuverability, a smoother ride at both high and low speeds, less side to side rolling motion when stationary in waves and greater weight carrying capacity.

Background Information

Boat hull design has been a constantly evolving field of art for thousands of years. In particular, the development of non-wind propulsion systems, material science and other technologies, has contributed to many advances in hull design over the past two hundred years.

Flat-bottom boats have a large, substantially flat hull bottom, making them very stable in calm weather. Characteristically, however, the flat, broad bow area creates a rough ride. These boats are usually limited to low horsepower motors because they do not generally handle well at high speed. Flat-bottom boats are also well suited for shallow water.

Early in nautical history, boats were powered by wind or by hand-stroked oars. Early boat designers found that boats went faster, and were easier to steer, if the bow was pointed. They also soon discovered that by lowering the center of gravity, the sailing boats had better stability, and usually kept the boat upright even in bad weather.

With the advent of mechanical power came boats with "planing" hulls, which lift the boat partially out of the water to skim on the surface allowing the boat to be operated at higher speeds for the same power. "Displacement" hulls push through or cruise through the water instead of skimming on the surface and are not able to operate at the higher speeds of a planing hull.

"Semi Displacement" hulls act in a manner part way between Displacement hulls and Planing hulls. At slow speeds they are more efficient than Planing hulls but not as efficient as Displacement hulls, while at medium speed they are more efficient than both Displacement and Planing hulls. Semi Displacement hulls are not usually able to operate at the high speeds typical of Planing hulls but are able to operate efficiently at higher speeds than a Displacement hull.

The V bottom boat is probably the most common hull design for planing hulls. Most manufacturers of performance boats built today use variations of this design. This design offers a reasonable ride in rough water as the pointed bow slices through the water forward and the V-shaped bottom softens the slamming of the boat in waves. The angle of the V is called "deadrise". A sharper V has more deadrise. Some "V"-bottom boats have a small, local flat surface at the very bottom of the aft end called a "pad." This pad creates a little more lift which increases top speed but at the sacrifice of a little softness in the ride.

A chine in V bottom planing or semi-displacement power boat hull forms refers to the hard corner or edge at the intersection between the hull bottom and the hull side.

With sailboats, it is common to have a rounded hull with no strakes or chines. A keel is often employed. However, the keel of a sailboat generally is generally deep vertically in proportion to the overall depth of the hull. On modern designs, it does not typically run the length of the boat.

Boats having a flatbottom, are stable at low speed while also being maneuverable and provide a large displaced volume for a given draft, thus accommodating more weight.

A deep V hull provides a relatively smooth ride at high speed. However, at low speed a deep V hull is very inefficient. Furthermore, at low speeds, a deep V hull is less stable, less maneuverable and tends to roll side to side to a high degree when side on to the waves.

Many attempts have been made to design hulls that combine features of flatbottom, round and/or deep V hulls in an effort to design hulls exhibiting the advantages of each.

In view of the foregoing, there is a need to provide a hull design that performs well at both high and low speeds. It is therefore desirable to provide a hull combining improved performance and ride comfort of any of the existing hulls at speed and in waves and improved comfort of any of the existing hulls at slow speed in waves and when stationary in waves.

BRIEF SUMMARY OF THE INVENTION

Accordingly, the primary object of the present invention is to provide a boat hull that provides a smooth ride at both high and low speeds with good fuel economy and maneuverability.

A high and moderate speed boat hull incorporates a keel running the center line of the hull starting 20 to 25% aft of the bow continuing aft 75 to 80% from the bow. The hull has a larger V shaped forward section twisting and flattening out running aft to a much lesser of a V with combinations of flat keel pad and ellipsoidal shaped areas. The keel provides both lift and lessens impact in rough water. The keel has a convex shape vertically and is shallow compared to any other keel. the keel starts thin and is narrow widening aft and tapers gently back to a point with an angel rising aft and up to the hull. This aft shape of the keel directs or allows the water to flow naturally back together over the flat keel pad to create solid water to feed to the engine propeller or propellers. The flat keel pad has two purposes: 1. a dedicated support for the vessel's riding or planning angle. 2. Is it is actually a step and allows the vessel to pivot at high speed and at all speeds giving the vessel greater maneuverability. The V port and starboard of the keel is the area feeding the lifting strakes. The lifting strakes works with the keel to provides positive lift and continues to create the softness of the ride these areas provide. The lifting strakes are shaped in a triangular manner pointing downward and has a radios inside of the lifting strake helping to create the curl of the natural shape of waves both providing lift and softness of the ride in a choppy or rough sea. Outside the lifting stakes continues the genital ellipsoidal shape of the hull and feeds the water out and aft. The spoilers also provide lift both forward in the lager V area and moving aft to the chine flats.

The spoilers also provide softer looser water or soiled water to the chine flats aft relieving friction of wetted surface of the hull. The chine flats are wider than most of any hull designs. The chine flats provide stability at rest and on plane at high speed and in a side rougher sea. The chine flats also provide a positive buoyancy giving and assisting the keel and the lifting strakes and the hull a direct attitude from rest to a full plane without squatting, digging or typically raising the bow high out of the water which also allows the vessel to reach a plane and high speed in very shallow water. The chine flat has a step 5 to 10% forward of the transom relieving friction of the wetted surface of the hull. The chine flats are assisted by the bracket or extension which is also a step. The bracket has a large flat bottom angling downward aft of the transom creating more assist in planning as a large trim tab.

The bracket adds buoyancy to support the weight of engine or engines. The bracket provides positive lift in a following sea lifting up on the inside of the wave and moving the vessel forward decreasing or eliminating the sea engulfing the engine or engines and or sinking the vessel. The bracket's large flat area adds additional stability supporting the chine flats in the side to side motion laying to in large seas preventing violent rocking motion of this vessel. the bracket is also a step allowing this vessel design to pivot over the water aft of the transom and as the bracket dose not touch the water at speed or plane it does not create drag at speed.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
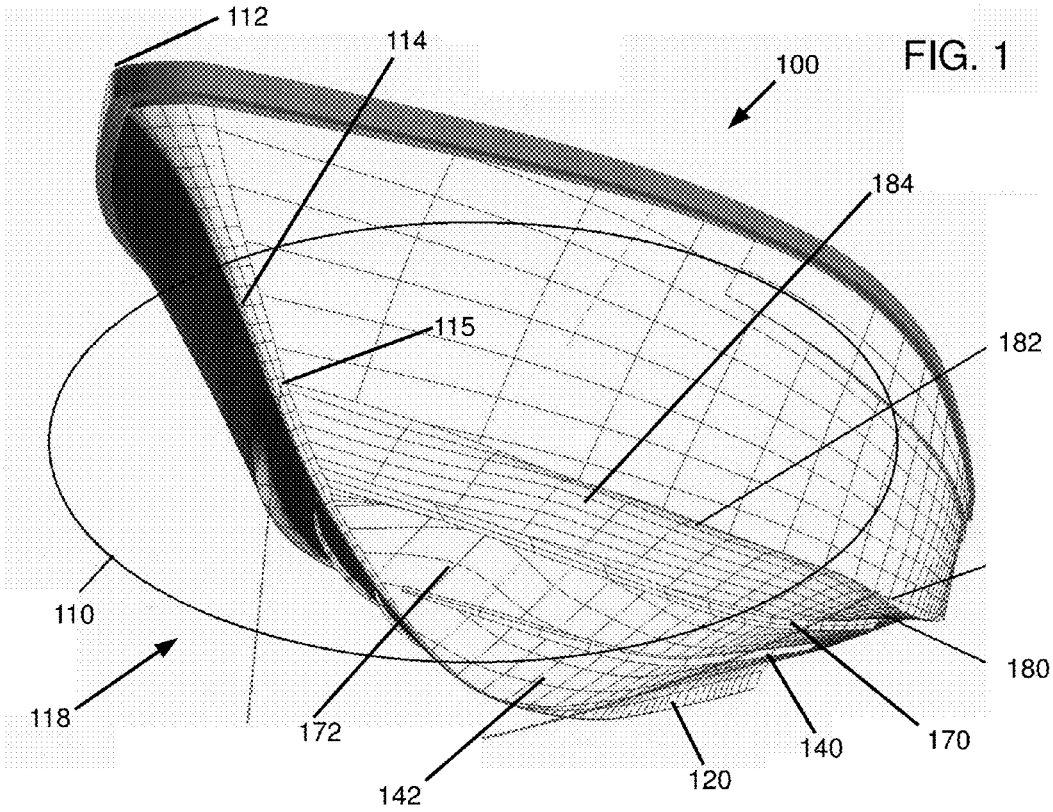
FIG. 1 is a forward perspective view of a boat hull in accordance with the principles of the invention.
Figure 2:
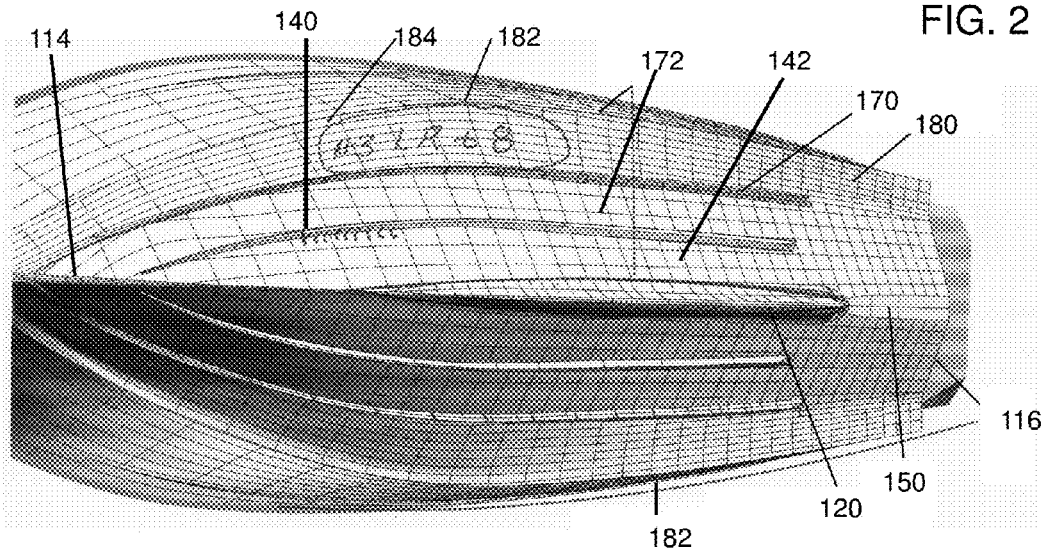
FIG. 2 is a bottom perspective view of a boat hull in accordance with the principles of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Disclosed is a hull design that improves the stability of a boat at low speed and efficiency at high speed. The forward region of the hull may have a bulbous, i.e. ellipsiodal, area that may be centered around the chine within the impact zone of the boat. The impact zone is the area or region of the hull impacted by water projecting upward due to the hull moving through water and is generally in a region extending from about 15% to about 35% down the length of the bottom of the hull. Modified chines and strakes may by combined to reduce drag at lower speeds typical of a flatbottom boat while also having the stability of a deep hull boat at higher speeds. Lifting strakes, or spoilers, may also contribute to reduce drag. An aft centerline pad may also be incorporated into the hull design.

The hull may also have a mid and aft ellipsoidal fullness aft of the forefoot and forward ellipsiodal fullness. The ellipsoidal fullness may continue to a lesser extent all the way to the transom. Without being bound by theory, the inventor believes that the mid and aft ellipsiodal fullness may work synergistically with the forefoot and forward ellipsiodal fullness to allow for a more natural water flow and makes for a smoother ride in large chop conditions.

The chine near the bow may be of a conventional design, but may include a bulge or fullness in the impact zone. Aft of the bow, in the area at the aft end of the forefoot and forward ellipsiodal fullness, the chine flat may become wider and may sweep around the mid and aft ellipsoidal fullness. The dead rise angle of the hull in this area may gradually flatten until it becomes a continuation of the chine flat as one wide surface on each side of the hull. This wide chine flat may continue aft with a slight negative dead rise angle. The wide chine flat may vary in dead rise and width, and may be stepped. The hull and chine flat in accordance with the invention may create extremely high levels of stability both at speed and when stationary in wave and cross wave conditions.

A keel may begin at a point aligned with the impact zone and extend aft along the centerline to a point near the hull's center of gravity. The keel may be shallow keel and extend aft widening along a convex path and having concave sides. The keel may blend into the hull with a large radius. The keel may have a tear drop shape similar to an airfoil, but in a direction opposite to a NACA keel. The aft end of the keel may taper to a fine section to promote clean water flow. The keel may promote natural water flow, and may enhance slow speed and at rest stability especially in cross waves, and works together with the forward ellipsiodal fullness and the mid and aft ellipsoidal fullness to create a smoother ride in large chop conditions. A flat centerline pad may provide lift at speed and is also used to control planing attitude in extreme conditions.

On each side of the hull there may be one or more lifting strakes also to be known as spoilers. The outboard edges of the spoilers may be lower than the inboard edges (negative deadrise) and the inboard and outboard edges may be blended into the hull with a radius on each edge. Without being bound by theory, the spoilers may create lift and may simultaneously interact synergistically with the keel and with the wide aft chine flat to create a smoother, more stable ride in large chop conditions and in slow speed or when stationary in cross wave conditions.

FIGS. 1-6 show one exemplary embodiment a boat hull 100 in accordance with the principles of the present invention. The boat hull 100 may be generally described as having a modified V-hull. The hull 100 includes a keel 120, a spoiler 170 and a lifting strake 140. The lifting strake 140 runs parallel to and equidistant from both the keel 120 and the spoiler 170. The hull 100 has a V-shaped forward region, and the hull bottom twists down the length of the hull and the lateral region 184 flattens out as it travels down the length of the hull 100 so that it becomes a chine flat 180 which extends to the stern.

The boat hull 100 has a bow 112 and stem 114. Those skilled in the art will appreciate that the term stem is used to refer to the leading edge of a boat hull. The hull 100 has a total length defined by the bow 112 and the transom 116. The bottom 118 of the boat hull 100 is generally defined as the portion of the hull 100 below the chine 182. The length of the bottom 118 is generally defined as the distance between the transom and the point 115 where the stem 114 intersects the chine 182. Generally, when identifying a position on the hull 100 by the approximate percentage of the distance along the hull length, it is in reference to the length of the hull bottom 118 below the chine.

The keel 120 is aligned with the centerline 122 of the hull 100. In this embodiment, the keel begins at a point on the hull bottom 118 about 20-25% aft of the bow and continues aft to a terminal end 124 to a point about 75-80% from the bow 110. Without being bound by theory, the inventor believes that the keel 120 provides both lift and lessens impact in rough water.

The bottom 118 of the hull 100, for clarity in defining certain aspects of the invention, may be characterized as having regions. The regions of the bottom 118 between the keel 120 and the lifting strake 140 is referred to herein generally as the medial region 130. The region of the bottom 118 between the lifting strake 140 and the spoiler 170 is referred to herein as the intermediate region 160. The region of the bottom 118 between the spoiler 170 and the chine 182 is referred to herein as the lateral region 184. The lateral region 184 has almost the same dead rise angle and is almost parallel to the medial 130 in the intermediate 160 regions of the hull in the forward region 110 of the hull 100. As the lateral region 184 extends aft, it twists from the forward configuration into a substantially horizontal configuration, thereby forming the chine flat 180.

Figure 3:
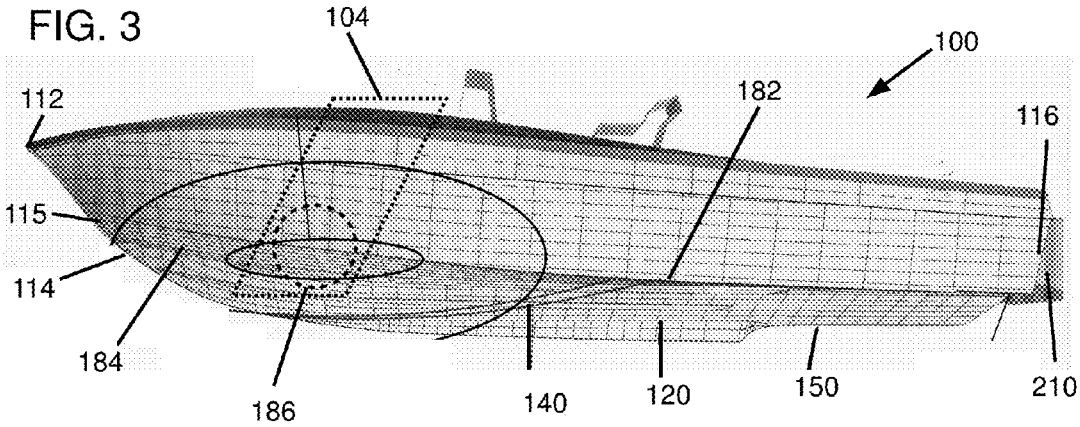
FIG. 3 is a side perspective view of a boat hull in accordance with the principles of the invention.
Figure 4:
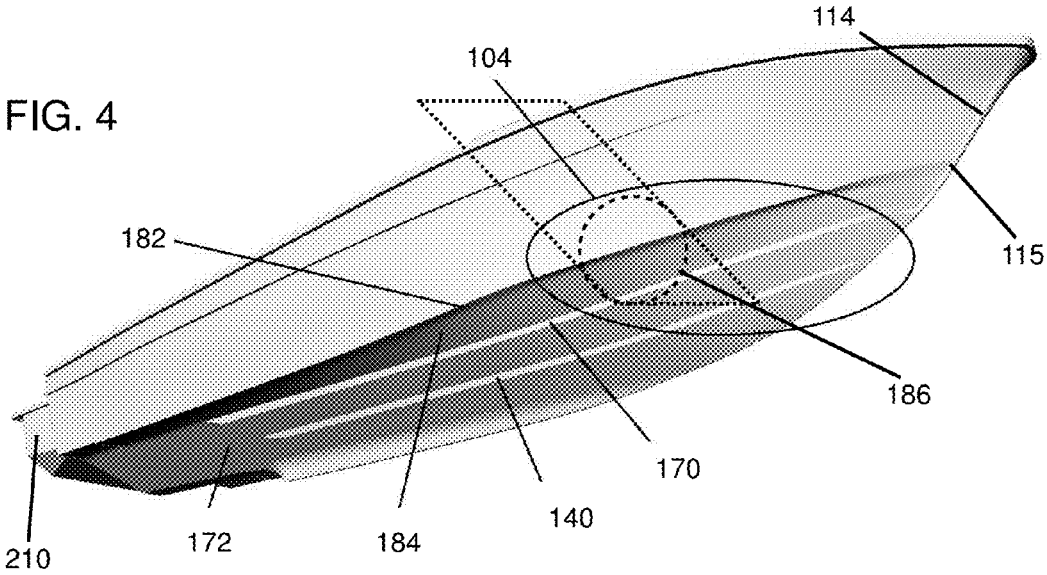
FIG. 4 is another perspective view of a boat hull in accordance with the principles of the invention.

Referring to FIGS. 3 and 4, the boat hull 100 has an "impact zone" 104 located within a region 15-35% down the length of the hull bottom 118. This is the region where water impacting the forward region 110 of the hull 100 is projected into the air by the force of the impact with the hull 100 as it travels through the water.

Figure 5:
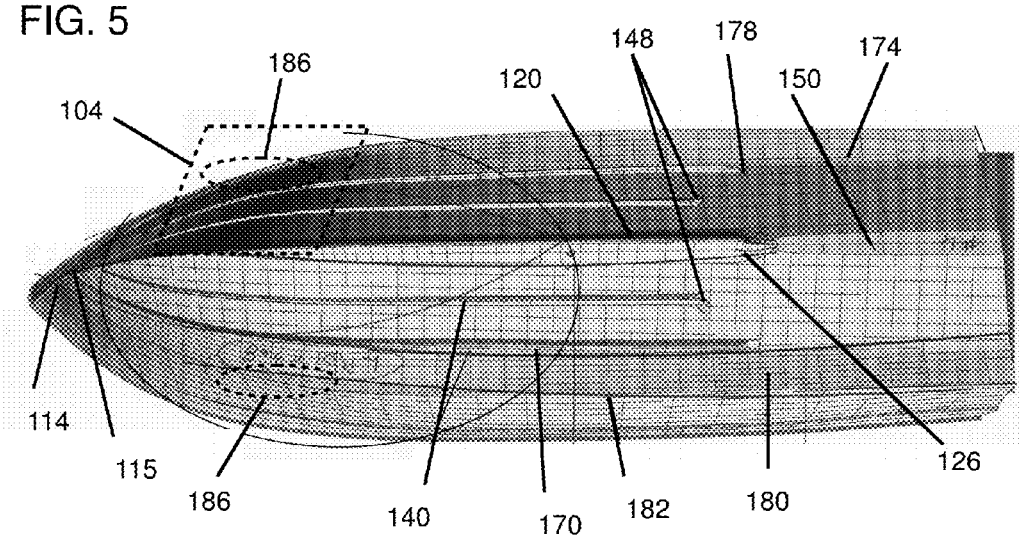
FIG. 5 is another bottom perspective view of a boat hull in accordance with the principles of the invention.
Figure 6:
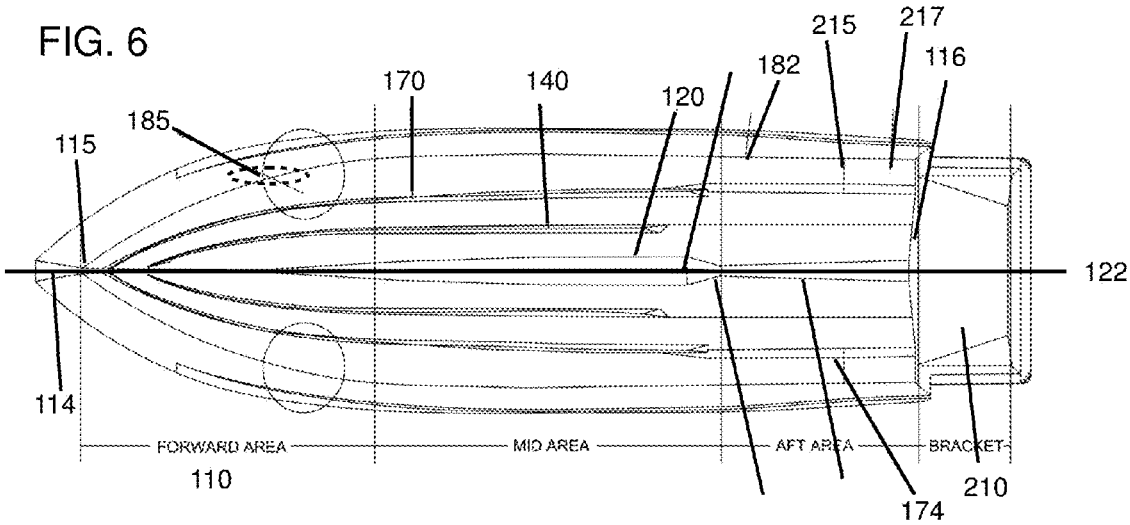
FIG. 6 is bottom plan view of a boat hull in accordance with the principles of the invention.

Referring to FIGS. 5 and 6, the region 174 of the hull bottom 118 located aft of the spoilers 170 is radiused, i.e. is curved rather than having a pointed angle. This facilitates the movement of water and a more natural manner. The spoilers 170 typically have a terminating end 178 located at substantially the same point along the length of the hull 100 as the widest point 126 of the keel 120. For clarity, the lifting strakes 140 are not shown in FIGS. 7-13. However, in the other figures it may be seen that the lifting strakes 140 has terminating ends 148 closer to the bow than the terminating ends 178 of the spoilers 170. FIG. 6 also shows a pad 217 extending from a step 215. In some embodiments, the pad 217 may be referred to as a trimtab. Generally, the step 215 is relatively small, only an inch or two. This additional step 215 and pad 217 improve maneuverability of the vessel.

Figure 7:
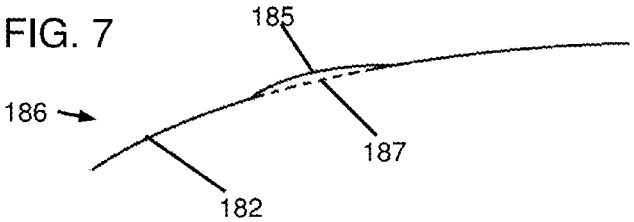
FIG. 7 is a diagram of a chine of a boat hull having a bulge in accordance with the principles of the invention.

The region 186 of the chine 182, in accordance with the principles of the invention, has a slight bulge 185 as shown in FIG. 7. V-hull boat designs typically include components that are substantially parallel to one another. It is common for the chine, strakes and other components to follow the lines of the hull itself and run parallel. A hull 100 of the present invention, however, includes a region 186 within the impact zone 104 more or less centered around the chine 182 having a bulge 185 that is not parallel with the other components of the hull 100 and extends outward from line 187 which illustrates a normal curve of a chine parallel to the hull bottom 118. Without being bound by theory, the inventor believes that the bulge 185 engages water projected upward in the impact zone and uses the force of the water to stabilize the hull 100 to provide a smoother ride and/or facilitate planing of the hull and/or improve maneuverability of the boat.

Figure 8:
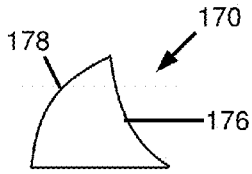
FIG. 8 is a cross-section of a lifting strake or spoiler of a boat hull in accordance with the principles of the invention.

Both the lifting strake 140 and the spoiler 170 may have a substantially triangular cross-section similar to common strakes. Optionally, the lifting strake 40 and the spoiler 170 may have a modified design with a convex lateral side 142 and a concave medial side 144 as shown in FIG. 8. Without being bound by theory, the inventor believes that the medial curvature along the strakes and spoilers facilitates a natural water flow, thereby improving efficiency of the design and providing a smoother ride of the boat itself.

Figure 9:
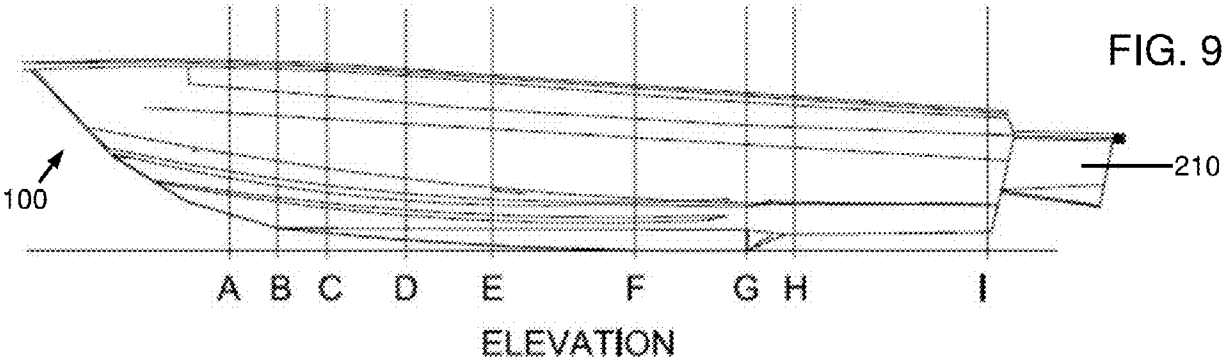
FIG. 9 is a side view showing sections of a boat hull in accordance with the principles of the invention.
Figure 19:
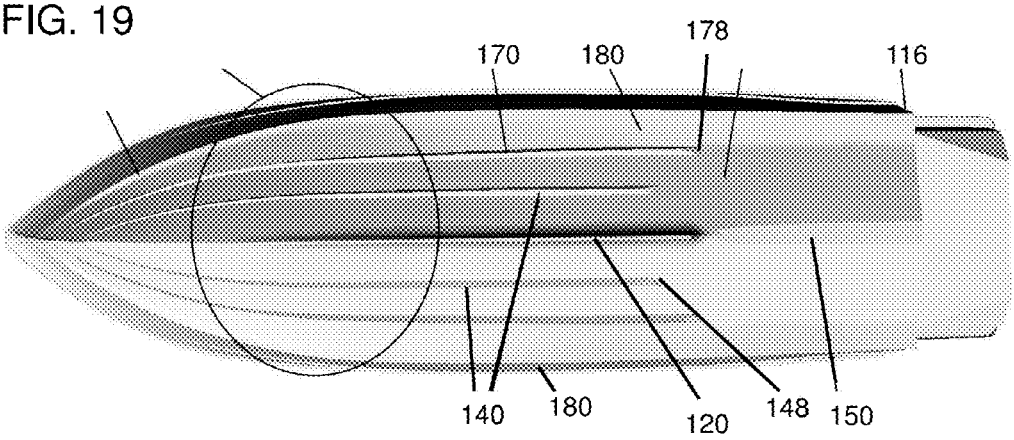
FIG. 19 is another perspective bottom view of a boat hull in accordance with principles of the invention.
Figure 20:
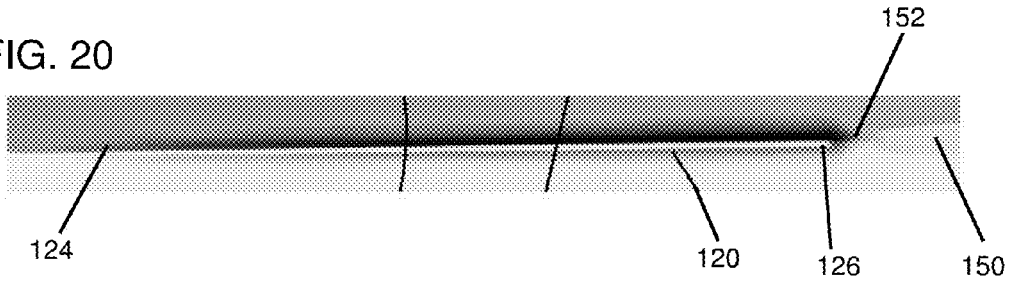
FIG. 20 is a bottom perspective view of a keel of a boat hull in accordance with the principles of the invention.
Figure 21:
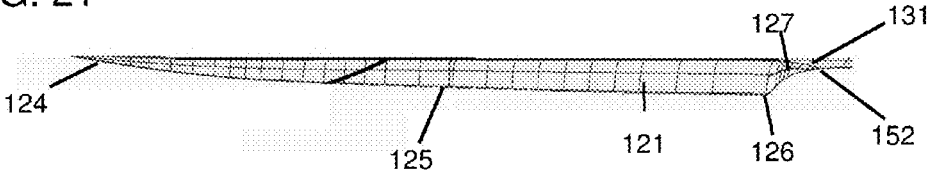
FIG. 21 is a side elevation will view of a keel of a boat hull in accordance with the principles of the invention.
Figure 22:
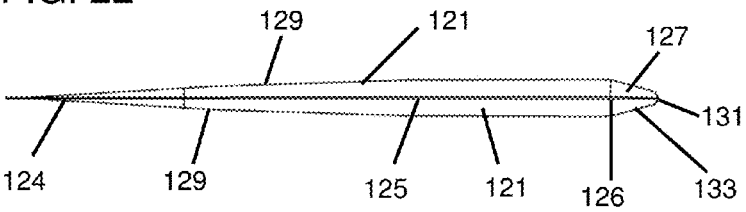
FIG. 22 is a bottom plan view of a keel of a boat hull in accordance with the principles of the invention.

FIGS. 9-18 show section profiles A-I of the hull 100 along the lateral, or transverse, planes identified in FIG. 9. Section A is 15% down the length of the hull bottom 118. Section B is 21% down the length. Section C is 26% down the length. Section D is 35% down the length. Section E is 44% down the length. Section F is 59% down the length. Section G is 71% down the length. Section 8 is 77% down the length. Section I is 97% down the length.

Figure 13:
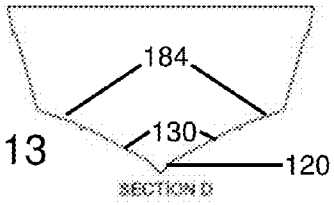
FIG. 13 is a cross-sectional view of a boat hull in accordance with the principles of the invention.
Figure 12:
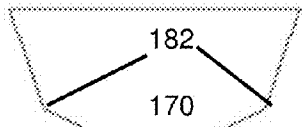
FIG. 12 is a cross-sectional view of a boat hull in accordance with the principles of the invention.
Figure 11:
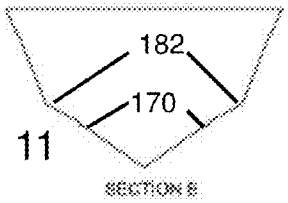
FIG. 11 is a cross-sectional view of a boat hull in accordance with the principles of the invention.
Figure 10:
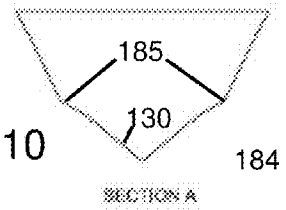
FIG. 10 is a cross-sectional view of a boat hull in accordance with the principles of the invention.

FIG. 10 shows section A which is located near the forward edge of the impact zone 114, and shows the bulge 185. The dead rise of the hull bottom 118 is greatest here. The lateral region 184 has a slightly smaller dead rise angle, due in part to the bulge 185. FIG. 11 shows section B which is located just aft of the bulge 185. Here, the lateral region 184 still has a dead rise angle slightly less than the dead rise angle of the medial and intermediate regions 130 and 160, respectively. FIGS. 12 and 13, showing lateral sections C and D, respectively, also show the lateral region 184 having a dead rise angle almost equal to the dead rise angle of the other regions of the bottom 118. This is due more to the flattening and decreasing dead rise angle of the medial and intermediate regions 130 and 160 as they move down the length of the hull bottom 118 than it is to a change in the dead rise angle of the lateral region 184. The bulge 185 in this embodiment is positioned in the forward region of the impact zone. The bulge may optionally be located at a different place within the impact zone or throughout the entire impact zone 114. Those skilled in the art will appreciate that the bulge 185 does not greatly diverge from a line 187 parallel to the other regions of the hull 100. The bulge 185 may optionally be larger or more pronounced. However, this is not necessary in order to obtain the beneficial results provided by the present invention.

Figure 18:
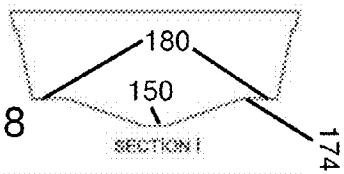
FIG. 18 is a cross-sectional view of a boat hull in accordance with the principles of the invention.
Figure 17:
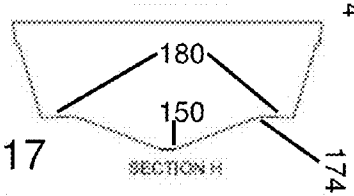
FIG. 17 is a cross-sectional view of a boat hull in accordance with the principles of the invention.
Figure 16:
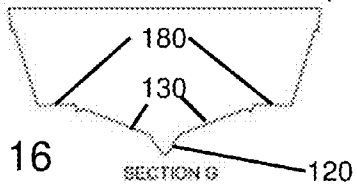
FIG. 16 is a cross-sectional view of a boat hull in accordance with the principles of the invention.
Figure 15:
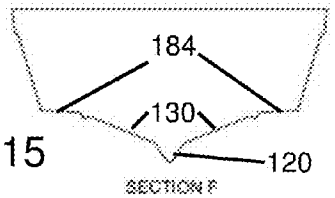
FIG. 15 is a cross-sectional view of a boat hull in accordance with the principles of the invention.
Figure 14:
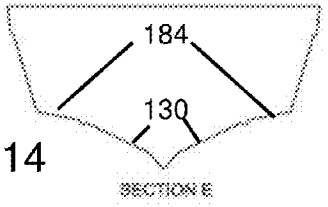
FIG. 14 is a cross-sectional view of a boat hull in accordance with the principles of the invention.

The spoiler 170 can be seen in sections A-G as positioned within the crux formed at the medial end of the lateral region 184. The keel 120 begins near section C shown in FIG. 12 and is first noticeable in section D shown in FIG. 13. The keel 120 reaches its highest and widest point near section G shown in FIG. 16. Section H, shown in FIG. 17 is aft of the keel. FIGS. 17 and 18 show sections H and I, respectively, where the keel pad 150 can be seen. Sections F-I show the lateral region 184 where it has become a chine flat 180 having a dead rise angle of about zero. The dead rise angle of the chine flat may preferably be between 5° and −5°. Referring to FIGS. 17 and 18, it may be seen that the aft region of the hull bottom 118 includes three flat regions, the two chine flats 184 and the pad 150. In addition, the medial region 130 and intermediate region 160, while not flat, have a relatively small dead rise angle.

FIGS. 19-23 show the keel 120 in more detail. The keel 120 has a rounded edge 125 and the sides 121 of the keel 120 are radiused, with a concave transverse profile. The keel 120 is shallower than most keels. The keel 120 is narrow at its front 124 and widens as it moves aft. The keel's widest point 126 is proximal to the center of gravity of the hull 100. Aft of point 126, the keel 120 tapers downward along a curved aft end 127 and intersects the bottom 118 of the hull 100 at the forward end 152 of the keel pad 150. Without being bound by theory, the inventor believes that the aft shape of the keel 120 directs or allows the water to flow naturally back together over the flat keel pad 150 to create solid water to be feed to the engine propeller or propellers.

The spoilers 170 have terminal ends 178 approximately aligned with the end of the keel 120. The terminal ends 148 do not extend as far aft as the spoiler terminal ends 178 or the keel 120. Without being bound by theory, the inventor believes that by having the spoilers 170 and the keel 120 longer than the lifting strakes 140, water flowing over the hull 100 flows more naturally, creating less friction and more stability at both low and moderate speeds.

The keel 120 itself, referring now to FIGS. 20-23, has a configuration similar to an airfoil, such as those promoted by NACA and considered fairly standard in hull design, but is inverted in accordance with the principles of the present invention. A typical NACA keel design has a relatively short and blunt forward end with a long, very gently sloping trailing end similar to an airfoil on an airplane. Keel 120 may be referred to as an inverted foil design.

Figure 23:
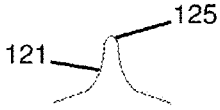
FIG. 23 is a cross-sectional view of a keel of a boat hull in accordance with principles of the invention.

The keel 120 of the present invention is similar to a NACA keel, but in reverse. The front of the keel 124 has a relatively sharp point. Leading edges 129 of the keel 120 provide a very gradual increase in width of the keel 120 along the length of the hull bottom 118. Leading edges 129 may be slightly convex. The sides 121 of the keel are themselves concave, as shown in FIG. 23. The keel 120 expands as it travels down the hull until it reaches its widest point 126. The keel 120 begins along the centerline at its front end 124 which is located in the same region as the impact zone. That is, the keel 120 typically begins between 15% and 30% down the length of the hull bottom 118. The widest point 126 is aligned with or very close to the center of gravity of the vessel. The aft end 127 of the keel 120 is located just aft of the widest point 126 and curves down in a concave manner and joined the hull bottom 118 at or near the forward end 152 of the centerline pad 150. In this embodiment, the keel 124 begins at about 22% down the length of the hull bottom 118, has a widest point at about 70% down the length of the bottom 118 and ends at about 75% of the length of the bottom. The leading portion of the keel, measured from the front 124 to the widest point 126, is therefore about 5 times the length of the trailing portion 127 of the keel, measured from the widest point 126 to the end 131 where it meets the bottom 118 proximal to the leading edge 152 of the centerline pad 150. That is, may be in the aft ⅔ of the keel, and may preferably about ⅚ aft of the total length of the keel. Generally, the leading portion of the keel is longer than the trailing portion of the keel. The trailing portion 127 is concave, but the trailing edges 133 around the trailing side 127, where the keel meets the bottom 118, may have a convex figuration, resembling the blunt end of a foil, or may optionally be straight.

The flat centerline pad, or keel pad, 150 is positioned aft of the keel 120 and extends to stern of the hull bottom 118. The function of the keel pad 150 is to keep the aft end on centerline from digging in at low speeds and in turns, which allows the boat to pivot within its own length on a point at the end of the keel at any speed. It also assists in bringing an early onset to planing during acceleration. Without being bound by theory, the inventor believes that the flat keel pad 150 serves two purposes. First, it is a dedicated support for the vessel's riding or planning angle. Second, it acts as a step and allows the vessel to pivot at high speed and at all speeds giving the vessel greater maneuverability.

The medial region 130 of the hull bottom 118, defined as the area of the hull bottom on both the port and starboard sides of the keel 120 between the lifting strakes 140. The medial region 130 extends from the bow all the way aft to the transom 116. In this embodiment, it has a deadrise angle of about 40-45 degrees at the bow 112, which twists and flattens, to about 17-20 degrees at the transom 116. This medial region 130 is bounded by the keel 120 inboard and the lifting strake 140 outboard. The medial region 130 is believed to function to dynamically lift the boat at speed and to provide the primary buoyancy area of the hull when planing.

The intermediate region 160 is the strip of bottom 118 outboard of the lifting strakes 140 and inboard of the spoiler 170. The intermediate region extends from the stem 114 all the way aft to the transom 116. It has a deadrise angle identical to the medial region 130. The inventor believes that the intermediate regions 160 function to provide dynamic lift at moderate speeds as the boat gets up on plane.

The lateral region 184 is the strip of bottom 118 outboard of the spoiler 170 and inboard of the chine 182, which extends from the stem 114 to the transom 116. The portion of the intermediate region 160 located past the terminal end 178 of the spoiler 170 transitions into the lateral region 174 by a fillet, or radiused area, 174 running from the terminal end 178 of the spoiler 170 to the transom 116. The fillet 174 is believed to allow the water to flow smoothly without abrupt changes of direction from the deadrise below to the much flatter deadrise of the chine flat 180. The intermediate region 160 has a deadrise angle of about 50-52 degrees at the bow, which twists and flattens into the chine flat which has between a 5 and −5 degree deadrise. The function of Area 4 is to provide dynamic lift at sub-planing speeds in order to start the boat up on plane. Trim tab pockets are set in the aft end of Area 4 to mount adjustable trim tabs should they be needed.

When in motion, the keel 120 and the lifting strakes 140 feed water flowing through the lifting strakes 140. The keel 120 is a vertical appendage to the hull on centerline, which adds longitudinal running stability to improve yaw control while planing. This structure tapers from thin at the bottom to thicker at the top, and has a small fillet at the transition to medial region 130. The purpose of this is to provide a gentle turning of the water flow from horizontal up and over onto the deadrise angle of region 130 without abrupt changes that cause hydrodynamic drag. The keel 120 may run aft from about 20-25% aft of the bow, to 75-80% of the length from the bow where it terminates with a radiused end to aid in developing a combination of flow separation and smooth rejoining of the water as it flows from the rear end.

The lifting strakes 140 works with the keel to provides positive lift and continues to create the softness of the ride these areas provide. The lifting strakes 140 are shaped in a triangular manner pointing downward and has a radios inside of the lifting strake 140 helping to create the curl of the natural shape of waves both providing lift and softness of the ride in a choppy or rough sea. Outside the lifting stakes 160 continues the genital ellipsoidal shape of the hull 100 and feeds the water out and aft. The spoilers 170 also provide lift both forward in the lager V area and moving aft to the chine flats 180. The Lifting Strakes 140 run from the bow aft to approximately 75% of the length of the hull. These strakes run approximately parallel to the chine, instead of tracing a waterline or buttock. In the midsection the lifting strakes flatten to horizontal, which causes the boat to run at a low bow trim angle near 0 degrees. These strakes also separate water flow from the area 2 strip, reducing friction and thus provide dynamic lift when the boat is fully planing.

The spoilers 170 also provide softer looser water or soiled water to the chine flats 180 aft relieving friction of wetted surface of the hull 100. The chine flats 180 are wider than most of any hull designs. The chine flats 180 provide stability at rest and on plane at high speed and in a side rougher sea. The chine flats 180 also provide a positive buoyancy giving and assisting the keel 120 and the lifting strakes 140 and the hull 100 a direct attitude from rest to a full plane without squatting, digging or typically raising the bow high out of the water which also allows the vessel to reach a plane and high speed in very shallow water. The chine flat 180 has a step 215 5 to 10% forward of the transom 116 relieving friction of the wetted surface of the hull 100. The chine flats 180 are assisted by the bracket or 210 which is also a step.

Figure 24:
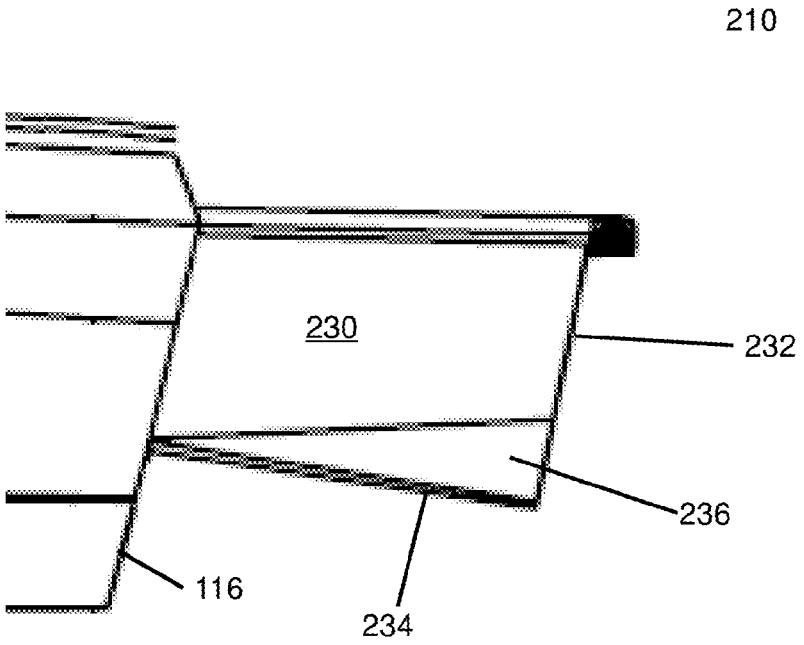
FIG. 24 is a side elevation oh view of a bracket of a boat hull in accordance with the principles of the invention.
Figure 25:
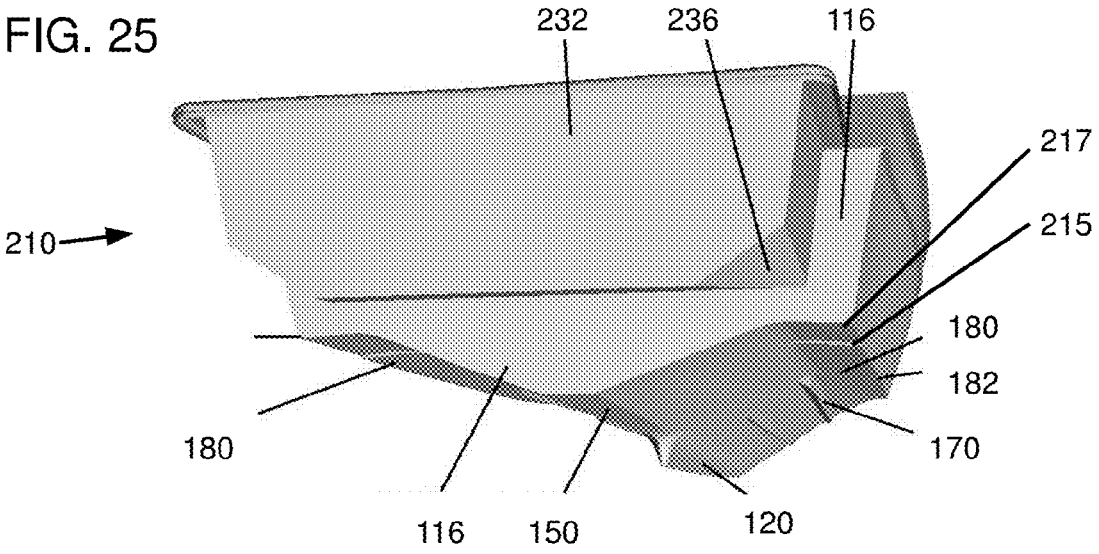
FIG. 25 is a rear perspective view of a bracket of a boat hull in accordance with the principles of the invention.

FIGS. 24-25 show the bracket 210 extending aft from the transom 116. The bracket 210 is defined by two sides 230, a back wall 232, an angled bottom 234 and two beveled corners 236. The bracket 210 has a large flat bottom 234 angling downward aft of the transom 116 creating more assist in planning as a large trim tab. The bracket 210 adds buoyancy to support the weight of engine or engines. The bracket 210 provides positive lift in a following sea lifting up on the inside of the wave and moving the vessel forward decreasing or eliminating the sea engulfing the engine or engines and or sinking the vessel. The bracket 210's large flat area adds additional stability supporting the chine flats 180 in the side to side motion laying to in large seas preventing violent rocking motion of this vessel. the bracket is also a step allowing this vessel design to pivot over the water aft of the transom 200 and as the bracket dose not touch the water at speed or plane it does not create drag at speed. The bottom 234 of the bracket 210 also smoothes the water as it moves aft toward a propeller of a motor mounted on the bracket 210. This action reduces cavitation of water being fed to the propeller.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A keel along the centerline of a V-hull boat comprising:

two symmetric sides and a curved bottom edge;

a front end beginning at a point between 15% and 30% down the length of the hull;

a leading edge having a length extending from the front end to a widest point of the keel, a trailing edge having a length extending from the widest point of the keel to an end point of the keel;

wherein the widest point of the keel is vertically aligned with the center of gravity of the V-hull; and, wherein the length of the leading edge is greater than the length of the trailing edge.

2. The keel of claim 1 wherein the V-hull further comprises a flat keel pad beginning at the end point of the keel.

3. The keel of claim 2 wherein along the centerline, the leading edge of the keel is convex and the trailing edge of the keel is concave.

4. The keel of claim 3 wherein, along a horizontal cross section, the leading edge of the keel is convex and the trailing edge is concave.

5. The keel of claim 4 wherein the length of the leading edge is more than twice the length of trailing edge.

6. The keel of claim 5 wherein the front end is pointed.

7. The keel of claim 6 wherein the length of the leading edge is five times the length of trailing edge.

8. The keel of claim 7 wherein the front end begins at a point between 20% and 25% down the length of the hull and the widest point of the keel is between 65% and 75% down the length of the hull.

9. The keel of claim 3 wherein, along a horizontal cross section, the leading edge of the keel is convex and the trailing edge is straight.

10. The keel of claim 9 wherein the length of the leading edge is more than twice the length of trailing edge.

11. The keel of claim 10 wherein the front end is pointed.

12. The keel of claim 11 wherein the length of the leading edge is five times the length of trailing edge.

13. The keel of claim 12 wherein the front end begins at a point between 20% and 25% down the length of the hull and the widest point of the keel is between 65% and 75% down the length of the hull.

* * * * *